US010919079B2

(12) United States Patent
Satou et al.

(10) Patent No.: US 10,919,079 B2
(45) Date of Patent: Feb. 16, 2021

(54) METHOD OF MANUFACTURING BAND-SHAPED METAL WIRE MEMBER INCLUDING BONDED PORTION

(71) Applicant: SUMITOMO WIRING SYSTEMS, LTD., Mie (JP)

(72) Inventors: Osamu Satou, Mie (JP); Jiguo Zheng, Mie (JP); Masamichi Yamagiwa, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 345 days.

(21) Appl. No.: 15/773,333

(22) PCT Filed: Nov. 4, 2016

(86) PCT No.: PCT/JP2016/082756
§ 371 (c)(1),
(2) Date: May 3, 2018

(87) PCT Pub. No.: WO2017/082159
PCT Pub. Date: May 18, 2017

(65) Prior Publication Data

US 2018/0318897 A1 Nov. 8, 2018

(30) Foreign Application Priority Data

Nov. 12, 2015 (JP) ..... 2015-221810

(51) Int. Cl.
*B21D 5/01* (2006.01)
*H01R 43/048* (2006.01)
(Continued)

(52) U.S. Cl.
CPC ..... *B21D 5/015* (2013.01); *B21C 37/06* (2013.01); *B21D 53/00* (2013.01); *B21F 15/04* (2013.01);
(Continued)

(58) Field of Classification Search
CPC ..... B21C 37/06; B21D 5/015; B21D 53/00; B21F 15/04; B21F 15/08; H01R 43/0207; H01R 43/048; H01R 4/18
See application file for complete search history.

(56) References Cited

U.S. PATENT DOCUMENTS 2,693,216 A * 11/1954 Broske ..... H01R 4/20 72/412
2,965,147 A * 12/1960 Hoffman ..... H01R 43/058 29/862
(Continued)

FOREIGN PATENT DOCUMENTS

JP 2011-082127 4/2011
JP 2013-037886 2/2013
(Continued)

OTHER PUBLICATIONS

Official Communication issued in International Bureau of WIPO Patent Application No. PCT/JP2016/082756, dated Jan. 31, 2017.

*Primary Examiner* — Carl J Arbes
(74) *Attorney, Agent, or Firm* — Greenblum & Bernstein, P.L.C.

(57) ABSTRACT

The present invention seeks to enable a band-shaped metal wire member to be stably accommodated within a die. A die is prepared that includes a bottom die provided with a depression and a top die provided with a projection that can be arranged within the depression so as to close off a space above the depression. An inner surface of the depression includes a central die surface formed at a width-direction center of a base of the depression and a pair of curved guide die surfaces provided continuous with two sides of the central die surface and curved so as to project outward. The central die surface is formed as a flat surface or as a surface that curves more gently than the pair of curved guide die surfaces. A bonding process portion of a band-shaped metal
(Continued)

wire member is folded in two and arranged within the depression.

6 Claims, 8 Drawing Sheets

(51) Int. Cl.

| | |
|---|---|
| ***B21F 15/08*** | (2006.01) |
| ***H01R 4/18*** | (2006.01) |
| ***B21D 53/00*** | (2006.01) |
| ***B21F 15/04*** | (2006.01) |
| ***B21C 37/06*** | (2006.01) |
| ***H01R 43/02*** | (2006.01) |

(52) U.S. Cl.
CPC ..... *B21F 15/08* (2013.01); *H01R 4/18* (2013.01); *H01R 43/0207* (2013.01); *H01R 43/048* (2013.01)

(56) References Cited

U.S. PATENT DOCUMENTS

| | | | | |
|---|---|---|---|---|
| 3,098,517 | A * | 7/1963 | Zimmerman, Jr. .. | H01R 43/058 72/397 |
| 4,976,132 | A * | 12/1990 | Shaffer ..... | H01R 43/058 29/753 |
| 6,513,235 | B1 * | 2/2003 | Ohsumi ..... | H01R 4/185 29/747 |
| 7,409,847 | B2 * | 8/2008 | Wightman ..... | H01R 43/058 29/283.5 |
| 9,444,154 | B2 * | 9/2016 | Suso ..... | H01R 4/021 |
| 10,186,824 | B2 * | 1/2019 | Satou ..... | H01R 4/02 |
| 10,395,793 | B2 * | 8/2019 | Satou ..... | H01B 5/02 |
| 2011/0094797 | A1 | 4/2011 | Otsuka et al. | |
| 2014/0311797 | A1 * | 10/2014 | Numata ..... | H01R 43/0207 174/75 R |
| 2015/0075863 | A1 | 3/2015 | Suso | |

FOREIGN PATENT DOCUMENTS

| | | |
|---|---|---|
| JP | 2014-003893 | 1/2014 |
| JP | 2014-011133 | 1/2014 |
| JP | 2014-211959 | 11/2014 |
| JP | 2015-060632 | 3/2015 |

* cited by examiner

METHOD OF MANUFACTURING BAND-SHAPED METAL WIRE MEMBER INCLUDING BONDED PORTION

FIELD OF THE INVENTION

The present invention relates to a technology that bonds metal wires of a band-shaped metal wire member together.

BACKGROUND OF THE INVENTION

Patent Literature 1 discloses a technology that forms a portion to be swaged, the portion being formed on an end portion of a braided metal wire portion and having metal wires resistance welded together, and swages a barrel of a terminal fitting to the portion to be swaged.

RELATED ART

Patent Literature

Patent Literature 1: Japanese Patent Laid-open Publication No. 2015-60632

SUMMARY OF THE INVENTION

Problems to be Solved by the Invention

The portion to be swaged is preferably formed in a shape and size that is approximately accommodated by the barrel. In order to achieve this, the end portion of the braided metal wire portion is preferably welded within a die.

However, when a braided wire having a band shape is used as the braided metal wire portion, arranging the band-shaped braided metal wire portion in the die stably is difficult. Therefore, there is an issue where the post-welding shape of the portion to be swaged may vary.

In view of the above, the present invention seeks to enable a band-shaped metal wire member to be stably accommodated within a die.

Means for Solving the Problems

In order to resolve the above-noted issue, a first aspect is a method of manufacturing a band-shaped metal wire member that includes a bonded portion, the method including: (a) a step of preparing a die that includes a first die provided with a depression and a second die provided with a projection that can be arranged within the depression so as to close off a space above the depression, an inner surface of the depression including a central die surface formed at a width-direction center of a base of the depression and a pair of curved guide die surfaces provided continuous with two sides of the central die surface and curved so as to project outward, the central die surface being formed as a flat surface or as a surface that curves more gently than the pair of curved guide die surfaces; (b) a step of folding in two a bonding process portion that is on at least a portion of an extension direction of the band-shaped metal wire member; (c) a step of arranging the bonding process portion of the band-shaped metal wire member within the depression such that two side edge portions of the bonding process portion are oriented toward the interior of the depression; (d) a step of inserting the projection into the depression and pressing the bonding process portion within the depression; and (e) a step of bonding metal wires in the bonding process portion together between the projection and the depression.

A second aspect is the method of manufacturing the band-shaped metal wire member that includes the bonded portion according to the first aspect, in which the central die surface is set to a width dimension no more than two times a thickness dimension of the band-shaped metal wire member.

A third aspect is the method of manufacturing the band-shaped metal wire member that includes the bonded portion according to the first or second aspect, in which the central die surface is a flat surface.

A fourth aspect is a method of manufacturing a terminal-equipped band-shaped metal wire member including: (A) a step of manufacturing a band-shaped metal wire member that includes a bonded portion with the method of manufacturing a band-shaped metal wire member that includes a bonded portion according to any one of the first to third aspects; and (B) a step of crimping a terminal to the bonded portion in a state where a positioning member is inserted into a gap between two side portions of the band-shaped metal wire member, at a location on the band-shaped metal wire member adjacent to the bonded portion.

A fifth aspect is a die that bonds a plurality of metal wires together in at least a portion of an extension direction of a band-shaped metal wire member, the die including: a first die provided with a depression; and a second die provided with a projection that can be arranged within the depression so as to close off a space above the depression. An inner surface of the depression includes a central die surface formed at a width-direction center of a base of the depression and a pair of curved guide die surfaces provided continuous with two sides of the central die surface and curved so as to project outward. The central die surface is formed as a flat surface or as a surface that curves more gently than the pair of curved guide die surfaces.

A band-shaped metal wire member that includes a bonded portion according to a sixth aspect is a member in which the bonded portion is formed by bonding the plurality of metal wires together in at least a portion of an extension direction of the band-shaped metal wire member, which is assembled such that the plurality of metal wires form an elongated band shape. The bonded portion is formed by bonding the plurality of metal wires together in a state where two side portions of the band-shaped metal wire member are deformed such that two side edge portions of the band-shaped metal wire member face each other and the two side portions meet on one principal surface side at a width-direction center portion of the band-shaped metal wire member. An outer circumferential surface of the bonded portion includes a central surface formed at the portion where the two side edge portions of the band-shaped metal wire member face each other, and a pair of curved surfaces that are provided continuous with two sides of the central surface and are curved so as to project outward. The central surface is formed as a flat surface or as a surface that curves more gently than the pair of curved surfaces.

Effect of the Invention

According to the first aspect, the bonding process portion of the band-shaped metal wire member is arranged within the depression such that the two side edge portions of the bonding process portion are oriented toward the interior of the depression, and the projection is inserted into the depression in this state, pressing the bonding process portion within the depression. The two side edge portions of the bonding process portion are then guided to the width-direction center portion of the base of the depression by the pair of curved guide die surfaces, and when the two side edge portions reach the central die surface, which curves gently or is a flat surface, the two side edge portions remain in a stable state. Therefore, the band-shaped metal wire member can be stably accommodated within the die. In addition, in this state, the metal wires in the bonding process portion are bonded together between the projection and the depression, enabling formation of a bonded portion having a stable shape.

According to the second aspect, the central die surface is set to a width dimension no more than two times the thickness dimension of the band-shaped metal wire member, and therefore a state can be achieved where the two side edge portions of the bonding process portion are more reliably positioned at the width-direction center of the depression.

According to the third aspect, the central die surface is a flat surface, and therefore the two side edge portions of the bonding process portion are more stable in a state where the two side edge portions are in contact with the central die surface at the width-direction center of the depression.

According to the fourth aspect, the terminal can be crimped to the bonded portion in a state where the bonded portion has been positioned, and therefore the format of crimping the bonded portion and the terminal together is stabilized.

According to the fifth aspect, the bonding process portion of the band-shaped metal wire member can be arranged within the depression such that the two side edge portions of the bonding process portion are oriented toward the interior of the depression (for example, downward), and the projection can be inserted into the depression in this state, pressing the bonding process portion within the depression. The two side edge portions of the bonding process portion are then guided to the width-direction center portion of the base of the depression by the pair of curved guide die surfaces, and when the two side edge portions reach the central die surface, which curves gently or is a flat surface, the two side edge portions remain in a stable state. Therefore, the band-shaped metal wire member can be stably accommodated within the die. In addition, in this state, the metal wires in the bonding process portion are bonded together between the projection and the depression, enabling formation of a bonded portion having a stable shape.

According to the sixth aspect, the plurality of metal wires can be bonded together in a state where the two side edge portions of the bonding process portion are guided to the portion of the die forming the central surface by the portion of the die forming the pair of curved surfaces. Therefore, a bonded portion having a stable shape can be formed.

MODE FOR CARRYING OUT THE INVENTION

In the following, a method of manufacturing a band-shaped metal wire member that includes a bonded portion; a die; and a band-shaped metal wire member that includes a bonded portion according to an embodiment are described.

Figure 1:
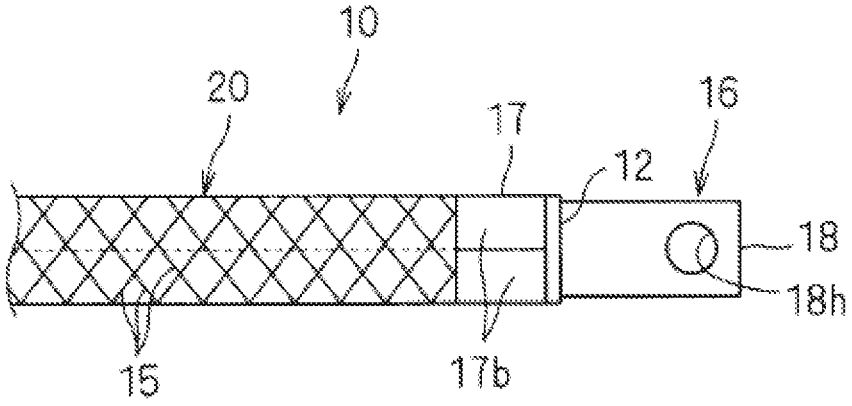
FIG. 1 is a schematic plan view illustrating a terminal-equipped band-shaped metal wire member.
Figure 2:
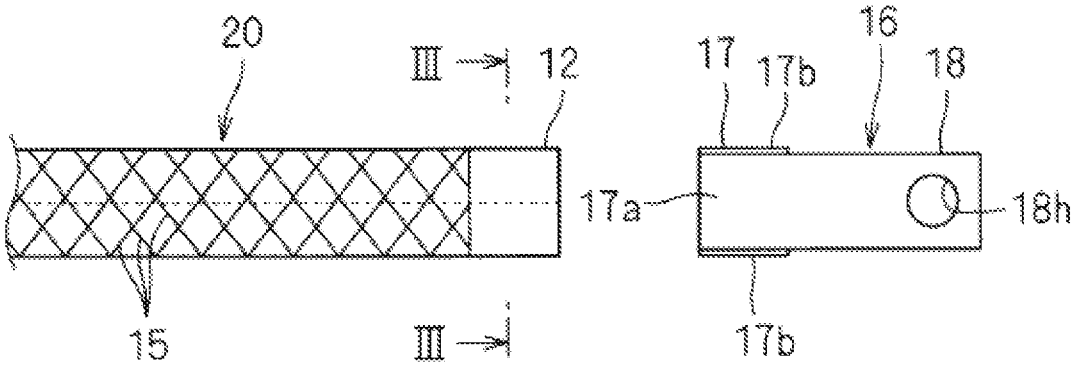
FIG. 2 is an explanatory diagram illustrating a state prior to connecting a terminal and a band-shaped metal wire member.
Figure 3:
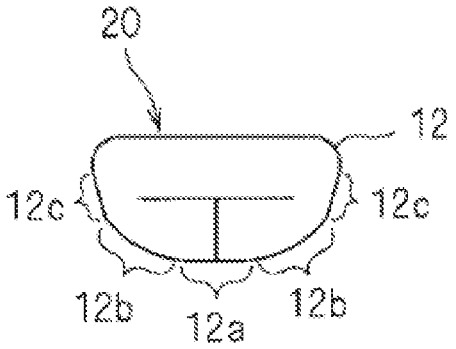
FIG. 3 is a schematic cross-sectional view along a line in FIG. 2.

First, a terminal-equipped band-shaped metal wire member 10 that is the final manufactured product is described. FIG. 1 is a schematic plan view illustrating a terminal-equipped band-shaped metal wire member. FIG. 2 is an explanatory diagram illustrating a state prior to connecting a terminal 16 and a band-shaped metal wire member 20. FIG. 3 is a schematic cross-sectional view along a line in FIG. 2.

The terminal-equipped band-shaped metal wire member 10 includes the band-shaped metal wire member 20, which is a conductive member, and the terminal 16.

The band-shaped metal wire member 20 is formed by processing a band-shaped metal wire member 20B (see FIGS. 6 to 9). In the description that follows, reference numeral 20B is used for the band-shaped metal wire member prior to processing, and when the band-shaped metal wire member 20B is processed and a bonded portion 12 is formed, this is described as the band-shaped metal wire member 20 that includes the bonded portion 12.

The band-shaped metal wire member 20B is assembled such that a plurality of metal wires 15 form an elongated band shape. The metal wires 15 may, for example, be configured exclusively by metal strands, or may be wires having a metal strand provided with a plating layer of a different metal than the strand, or the like. Examples of the metal strands may include a copper strand or a copper alloy strand. An example of the metal plating layer may be tin plating. However, the metal strand and metal plating layer are not limited to these materials. The band-shaped metal wire member 20B may be a member in which a member where the plurality of metal wires 15 are woven to form a cylinder (cylindrical braid or the like) is bent so as to be flat, or may be a member in which the plurality of metal wires 15 are initially woven to form a band shape (sheet-shaped metallic cloth, mesh, or the like).

In portions of the band-shaped metal wire member 20 other than the portion where the bonded portion 12 is formed, the plurality of metal wires 15 are assembled in a state capable of relative displacement, and have a band shape. Therefore, portions of the band-shaped metal wire member 20 other than the portion where the bonded portion 12 is formed are pliant enough to flex readily.

The bonded portion 12 is formed on the portion of the band-shaped metal wire member 20 where the terminal 16 is to be crimped, the bonded portion 12 being formed by bonding the plurality of metal wires 15 together. Bonding the plurality of metal wires 15 together may be performed by heat welding, or by ultrasonic welding.

The terminal 16 is a member formed by processing a metal plate of copper or the like by pressing, for example, and includes a crimping portion 17 and a connection portion 18.

The crimping portion 17 has a pair of crimping tabs 17*b* formed on two side portions of a base 17*a*, and is formed so as to have an overall "U" shape in cross-section. In addition, the pair of crimping tabs 17*b* are swage deformed inward in a state where the bonded portion 12 is arranged within the crimping portion 17, whereby the crimping portion 17 is electrically and mechanically connected to the bonded portion 12 at an end portion of the band-shaped metal wire member 20.

In addition, the connection portion 18 is a portion capable of connecting to a mating member that is a connection mate to the terminal 16. In this example, the connection portion 18 is formed in a plate-like shape provided with hole 18*h* capable of being fastened by a bolt and fixated to the mating member.

In this example, the band-shaped metal wire member 20B is a comparatively broad band-shaped member. In order to readily accommodate the end portion of such a broad band-shaped metal wire member 20B within the crimping tabs 17*b*, the end portion is preferably narrow. Therefore, the band-shaped metal wire member 20B is preferably folded so as to stack in a width direction thereof. In view of the above, the bonded portion 12 is formed on the band-shaped metal wire member 20B, forming the band-shaped metal wire member 20 that includes the bonded portion 12. More specifically, the band-shaped metal wire member 20B is folded at two places such that two side portions of the band-shaped metal wire member 20B are stacked on one principal surface side (see FIG. 3). In particular, the band-shaped metal wire member 20 is folded such that two side edge portions thereof face each other and touch. By bonding the plurality of metal wires 15 together in this state, the bonded portion 12 is formed. A width dimension of the bonded portion 12 is approximately half the width dimension of the original band-shaped metal wire member 20B. Accordingly, the bonded portion 12 can be readily accommodated within the crimping portion 17.

An outer circumference of the bonded portion 12 has the following shape. Specifically, as noted above, the plurality of metal wires 15 are bonded together in a state where two side portions of the band-shaped metal wire member 20B are folded so as to stack onto a width-direction center portion of one primary surface (bottom surface in FIG. 3) of the band-shaped metal wire member 20B such that the two side edge portions of the band-shaped metal wire member 20B face each other. Therefore, a fixed form as described above is maintained at the bonded portion 12 of the processed band-shaped metal wire member 20.

Figure 4:
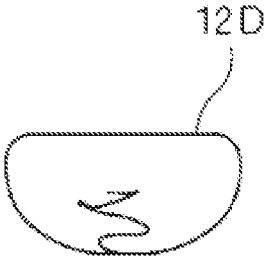
FIG. 4 is a schematic cross-sectional view illustrating another example of a bonded portion.

A case can also be considered of a form, such as in a bonded portion 12D illustrated in FIG. 4, where the band-shaped metal wire member 20B is folded in a state where the two side edge portions of the band-shaped metal wire member 20B face each other, such that a portion on the band-shaped metal wire member 20B just before the two side edge portions buckles or the like and is compressed (for example, a state folded in an accordion shape), and in this state the two side edge portions meet on one principal surface side at a center portion in the width direction of the band-shaped metal wire member 20B.

In other words, the bonded portions 12 and 12D can have a form where the two side edge portions of the band-shaped metal wire member 20B face each other and the two side portions of the band-shaped metal wire member 20B are deformed into an appropriate shape and meet on one principal surface side at the width-direction center portion.

A central surface 12*a* is formed at the width-direction center portion on one principal surface side of the outer circumferential surface of the bonded portion 12 (i.e., at the portion where the two side edge portions of the band-shaped metal wire member 20B face each other). In addition, a pair of curved surfaces 12*b* are formed at portions on one principal surface side of the outer circumferential surface of the bonded portion 12 and are continuous with the two side portions of the central surface 12*a*. The central surface 12*a* is formed as a flat surface, or as a surface that curves more gently than the curved surfaces 12*b*. In this example, the central surface 12*a* is formed as a flat surface. The central surface 12*a* is a surface that is parallel to the other principal surface side of the outer circumferential surface of the bonded portion 12 (parallel to the upper surface in FIG. 3). The central surface 12*a* may also be formed as a curved surface that projects outward, but that is gentler (a surface having a greater curvature radius) than the curved surfaces 12*b*. The curved surfaces 12*b* are surfaces curved so as to project outward. The curved surfaces 12*b* may be curved surfaces that curve at a uniform curvature radius across the entire extension direction thereof, or may be surfaces having a curvature radius that fluctuates at points along the extension direction thereof. The curved surfaces 12*b* are formed such that an angle of the curved surface 12*b* relative to the central surface 12*a* becomes more gentle as the curved surface 12*b* approaches the central surface 12*a*.

Figure 5:
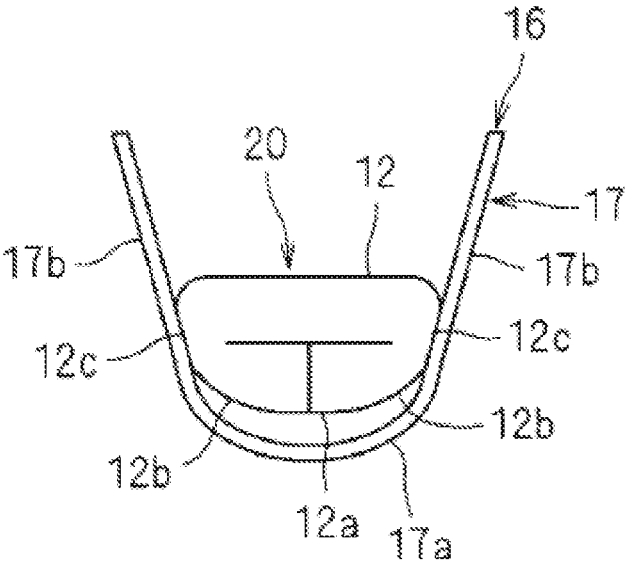
FIG. 5 is an explanatory diagram illustrating a relationship between the bonded portion and a crimping portion.

Furthermore, a pair of terminal placement surfaces 12*c* are each continuous with an outer side of the respective curved surface 12*b* of the pair of curved surfaces 12*b*. The pair of terminal placement surfaces 12*c* are formed in a shape that inclines such that as each terminal placement surface 12*c* advances outward on the two sides of the bonded portion 12, each terminal placement surface 12*c* approaches a surface on the opposite side from the central surface 12*a*. In other words, the pair of terminal placement surfaces 12*c* are formed so as to gradually grow broader from the one principal surface of the bonded portion 12 (bottom surface in FIG. 3) toward the other principal surface (top surface in FIG. 3). As illustrated in FIG. 5, a degree of incline of the pair of terminal placement surfaces 12*c* is set to a degree that conforms to the degree of incline of the pair of crimping tabs 17*b* of the crimping portion 17 of the terminal 16 to be crimped. In this example, the degree of incline of the pair of terminal placement surfaces 12*c* is set to the same degree of incline as the pair of crimping tabs 17*b*. Therefore, when the bonded portion 12 is arranged between the pair of crimping tabs 17*b* of the crimping portion 17, an inner surface of the pair of crimping tabs 17*b* is in contact with the pair of terminal placement surfaces 12*c* over a comparatively broad area. Therefore, the bonded portion 12 can be stably set within the crimping portion 17 and, by swaging the crimping portion 17 to the bonded portion 12 in this state, a mode of swaging the crimping portion 17 to the bonded portion 12 is stabilized. However, the presence of the terminal placement surfaces 12*c* is not strictly required.

A method of manufacturing the terminal-equipped band-shaped metal wire member 10 is now described.

First, the band-shaped metal wire member 20 that includes the bonded portion 12 is produced (step (A)).

Figure 6:
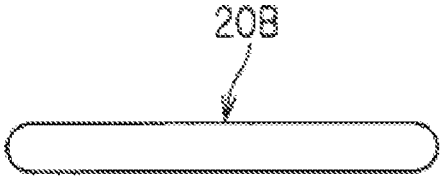
FIG. 6 is an explanatory diagram illustrating a step of forming the bonded portion.
Figure 7:
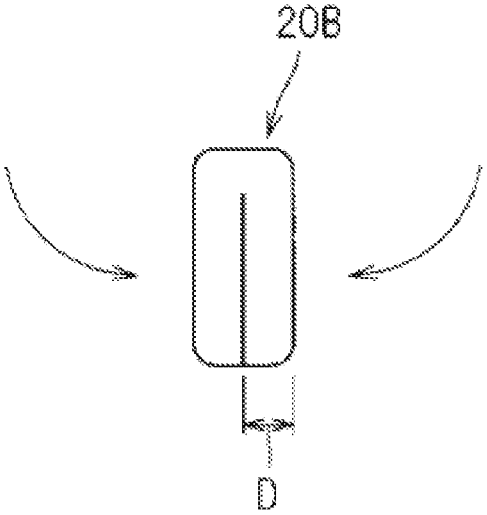
FIG. 7 is an explanatory diagram illustrating a step of forming the bonded portion.

In step (A), the band-shaped metal wire member 20B is prepared, as illustrated in FIG. 6. Then, as illustrated in FIG. 7, a bonding process portion on at least a portion of the extension direction of the band-shaped metal wire member 20B is folded in two (step (b)). More specifically, at least a portion of the extension direction of the band-shaped metal wire member 20B is folded in two on a line along the width-direction center of the band-shaped metal wire member 20B.

Then, a die 50 (explained below) is prepared (step (a)). Step (a) of preparing the die may also be performed prior to step (b) described above.

Figure 8:
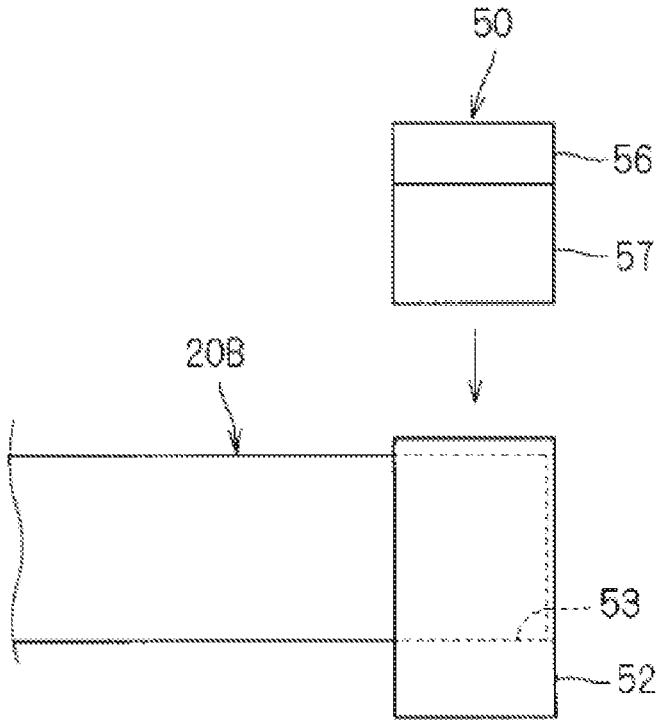
FIG. 8 is an explanatory diagram illustrating a step of die-molding the bonded portion.
Figure 9:
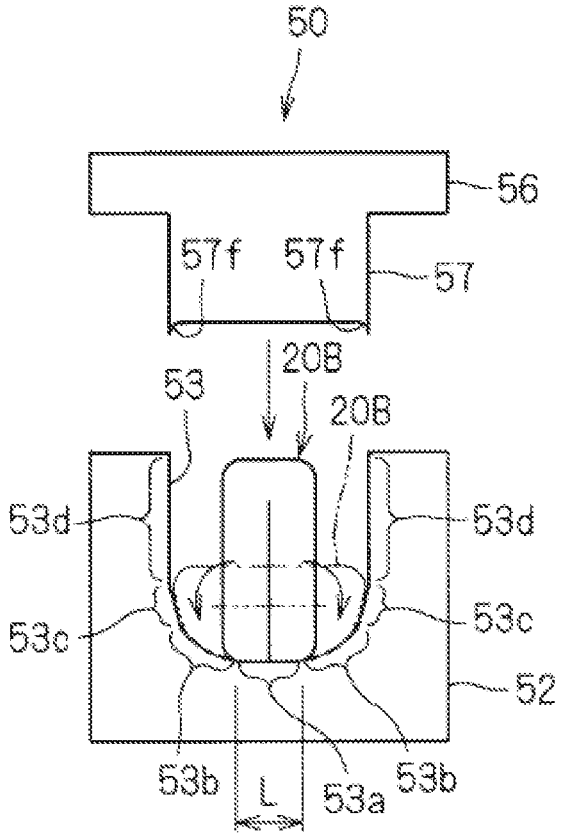
FIG. 9 is an explanatory diagram illustrating the step of die-molding the bonded portion.

As illustrated in FIGS. 8 and 9, the die 50 includes a bottom die 52 as a first die and a top die 56 as a second die. A depression 53 having a width dimension that corresponds to the width direction of the bonded portion 12 is formed in the bottom die 52. A projection 57 that can be arranged within the depression 53 so as to close off a space above the depression 53 is formed in the top die 56.

The inner surface of the depression 53 includes a central die surface 53*a* and a pair of curved guide die surfaces 53*b*. The central die surface 53*a* is formed at the width-direction center of the depression 53. The pair of curved guide die surfaces 53*b* are provided so as to be continuous with two sides of the central surface 12*a*.

The central die surface 53*a* is a die surface that forms the central surface 12*a*, and therefore, like the central surface 12*a*, the central die surface 53*a* is formed as a flat surface or as a surface that curves more gently than the curved guide die surfaces 53*b*. In this example, the central die surface 53*a* is formed as a flat surface. The central die surface 53*a* intersects orthogonally with a direction in which the top die 56 moves toward the bottom die 52. A width dimension L of the central die surface 53*a* (see FIG. 9) is preferably no more than twice a thickness dimension D of the band-shaped metal wire member 20B (see FIG. 7). Furthermore, the width dimension L of the central die surface 53*a* is preferably no more than the thickness dimension D of the band-shaped metal wire member 20B.

The pair of curved guide die surfaces 53*b* are die surfaces that form the pair of curved surfaces 12*b*, and therefore, like the pair of curved surfaces 12*b*, are formed in a shape that curves so as to project outward.

In this example, a pair of terminal placement surface formation die surfaces 53*c* are formed so as to be continuous with an outward side of the two side portions of each of the pair of curved guide die surfaces 53*b*. The pair of terminal placement surface formation die surfaces 53*c* are die surfaces that form the pair of terminal placement surfaces 12*c*, and are inclined so as to gradually open toward an upper opening of the depression 53. Formation of the terminal placement surfaces 12*c* is not strictly required.

A pair of side surfaces 53*d* are formed on the depression 53, rising directly above and on an outward side of the pair of terminal placement surface formation die surfaces 53*c*. Two side surfaces of the bonded portion 12 are formed by the pair of side surfaces 53*d*.

The projection 57 is formed in a shape having a width-dimension projection that is capable of fitting into the depression 53. A width-direction center portion of the foremost end of the projection 57 is further recessed than the two side edge portions thereof. Curved surfaces 57*f* that project outward are formed on an inner side of the two side edge portions. Two corner portions on the top of the bonded portion 12 are formed in a curved shape by the curved surfaces 57*f*.

After preparing the die 50 described above, the bonding process portion of the band-shaped metal wire member 20B is arranged within the depression 53 (step (c), see FIGS. 8 and 9) such that two side edge portions of the bonding process portion are oriented toward the interior of the depression 53 and such that a fold peak is oriented toward the opening of the depression 53.

Then, the top die 56 is moved toward the bottom die 52 by an air cylinder, hydraulic cylinder, or other actuator; the projection 57 is inserted into the depression 53; and the bonding process portion is pressed into the depression 53 by the foremost end of the projection 57 (step (d)). The fold peak of the band-shaped metal wire member 20B is then pushed downward and the band-shaped metal wire member 20B between the fold peak and the side edge portions is deformed so as to bulge outward. Then, a mode of folding is established where, in a state where a portion of the band-shaped metal wire member 20B between the fold peak and the side edge portions is folded in two, the two side portions of the band-shaped metal wire member 20B are stacked on one principal surface side of the band-shaped metal wire member 20B (see the two-dot-dashed line in FIG. 9). As illustrated in FIG. 4, the two side portions of the band-shaped metal wire member 20B may also be folded in multiple locations and deform such that the two side portions buckle. At this point, each of the two side edge portions of the band-shaped metal wire member 20B are pressed toward the pair of curved guide die surfaces 53*b* and displace toward the central die surface 53*a*, conforming to the curve of the pair of curved guide die surfaces 53*b* as the two side edge portions make contact therewith. Then, each of the two side edge portions of the band-shaped metal wire member 20B are stabilized, in a state pressed against the central die surface 53*a*.

In this state, for example, the bonding process portion of the band-shaped metal wire member 20B is partially heated through the die 50, which is heated by a heater or the like; at least a portion of the plurality of metal wires 15 (for example, the plating layer portion) melts, bonding the plurality of metal wires 15 together; and a state is achieved where a fixed shape is maintained. In this way, the bonded portion 12 is formed. The plurality of metal wires 15 may also be ultrasonically bonded together, resistance welded together, or the like between the bottom die 52 and the top die 56.

Figure 10:
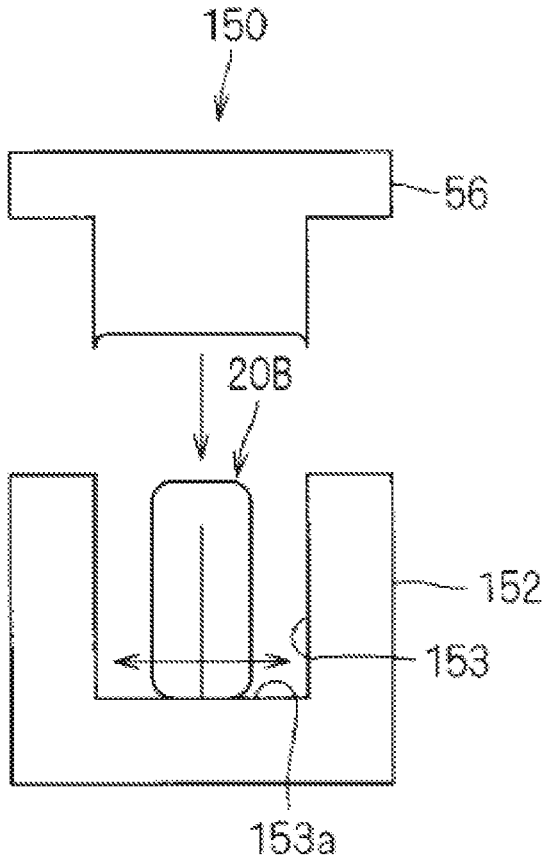
FIG. 10 is an explanatory diagram illustrating a first comparative example.

FIG. 10 illustrates an example where a bonded portion is formed using a die 150 according to a first comparative example.

Figure 11:
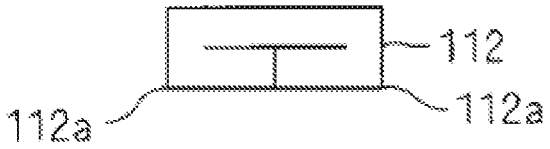
FIG. 11 is an explanatory diagram illustrating a bonded portion according to the first comparative example.

A depression 153 is formed in a bottom die 152 of the die 150, the depression 153 having a square shape in lateral cross-section. In this case, the band-shaped metal wire member 20B is folded in two, similar to the above description, and is arranged inside the depression 153. When pressed by the top die 56, the position of the two side edge portions of the band-shaped metal wire member 20B does not stably occupy any location in the width direction of a flat bottom surface 153*a* of the depression 153. Therefore, a portion of the processed bonded portion where the two side edge portions face each other is unstable. As illustrated in FIG. 11, at each corner 112*a* of a bonded portion 112, a compression force of the metal wires 15 may be insufficient, and therefore there is a chance that the metal wires 15 may separate from each other at the corners 112*a*. In contrast, a lower corner portion of the bonded portion 12 described above is pressed by the pair of curved guide die surfaces 53*b* (in this example, the bonded portion 12 is also pressed by the terminal placement surface formation die surfaces 53*c*) and takes on a shape with beveled corners. Therefore, the configuration provides sufficient compression and, thus, the plurality of metal wires 15 are sufficiently bonded together, as well.

Figure 12:
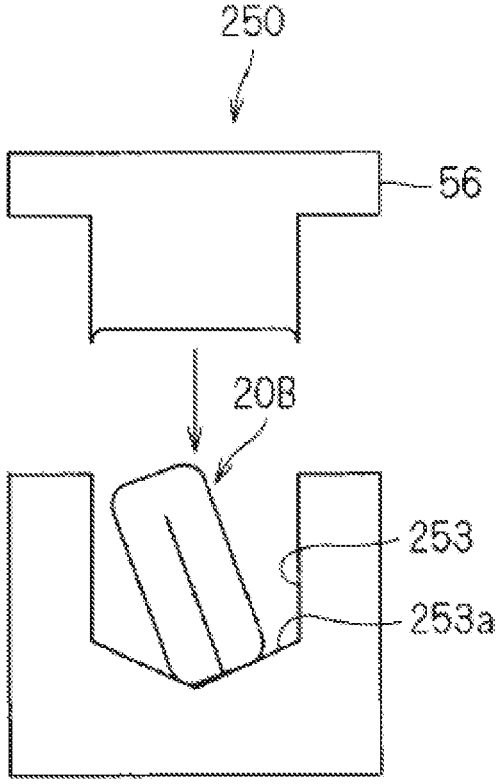
FIG. 12 is an explanatory diagram illustrating a second comparative example.

Alternatively, with a die 250 according to a second comparative example, illustrated in FIG. 12, a bottom surface 253*a* of a depression 253 is formed as a V-shaped groove that gradually narrows toward the base. In this case, the band-shaped metal wire member 20B is folded in two, similar to the above description, and is arranged inside the depression 253. When pressed by the top die 56, one of the two side edge portions of the band-shaped metal wire member 20B is arranged at the deepest point of the depression 253 and, as a result, a portion of the band-shaped metal wire member 20B between the two side edge portions may be arranged at a position offset from the width-direction center of the depression 253.

Figure 13:
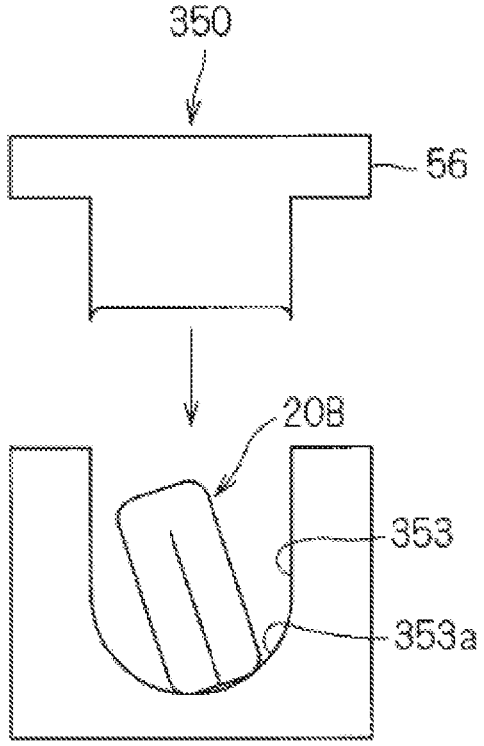
FIG. 13 is an explanatory diagram illustrating a third comparative example.

Alternatively, with a die 350 according to a third comparative example, illustrated in FIG. 13, a bottom surface 353*a* of a depression 353 is formed as a semicircular groove. In this case, the band-shaped metal wire member 20B is folded in two, similar to the above description, and is arranged inside the depression 353. When pressed by the top die 56, the two side edge portions of the band-shaped metal wire member 20B displace freely over the bottom surface 353*a*, and therefore a portion of the band-shaped metal wire member 20B between the two side edge portions is likely to be arranged at a position offset from the width-direction center of the depression 353.

In any event, in each of the comparative examples described above, the two side edge portions of the band-shaped metal wire member 20B are arranged at positions offset from the width-direction centers of the depressions 153, 253, and 353, and as a result there may be instability in the shape of the bonded portion. In particular, it is clear that the positions of the two side edge portions of the band-shaped metal wire member 20 are not uniform.

In contrast, when the die 50 is used, the positions of the two side edge portions of the band-shaped metal wire member 20 are, more reliably positioned at the width-direction center of the bonded portion 12, and the shape of the bonded portion 12 can be stabilized.

Figure 14:
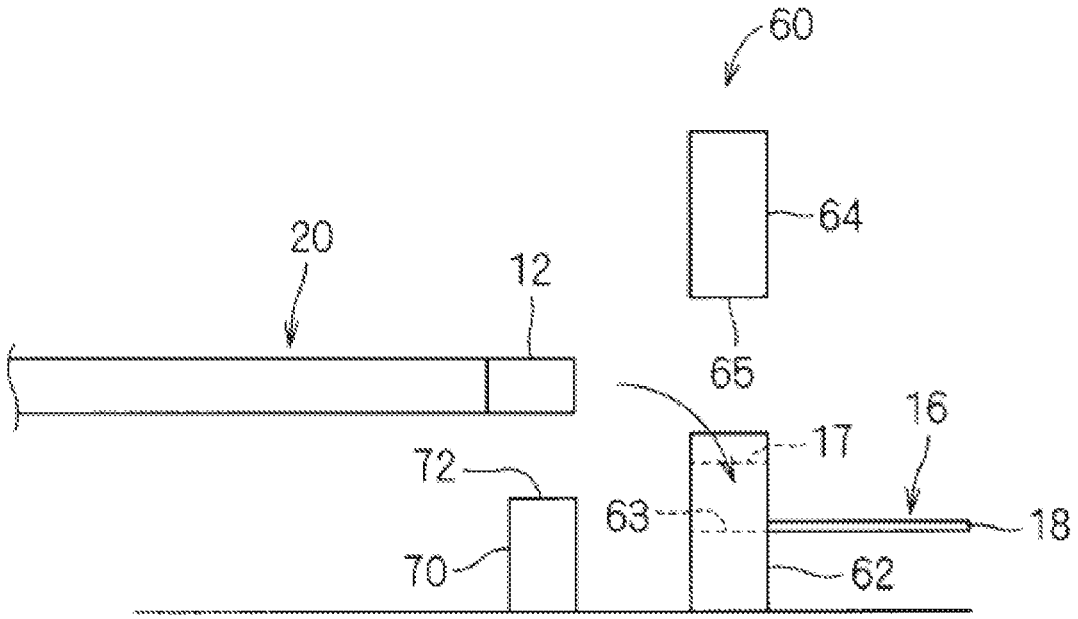
FIG. 14 is an explanatory diagram illustrating a step of crimping the terminal to the bonded portion.
Figure 15:
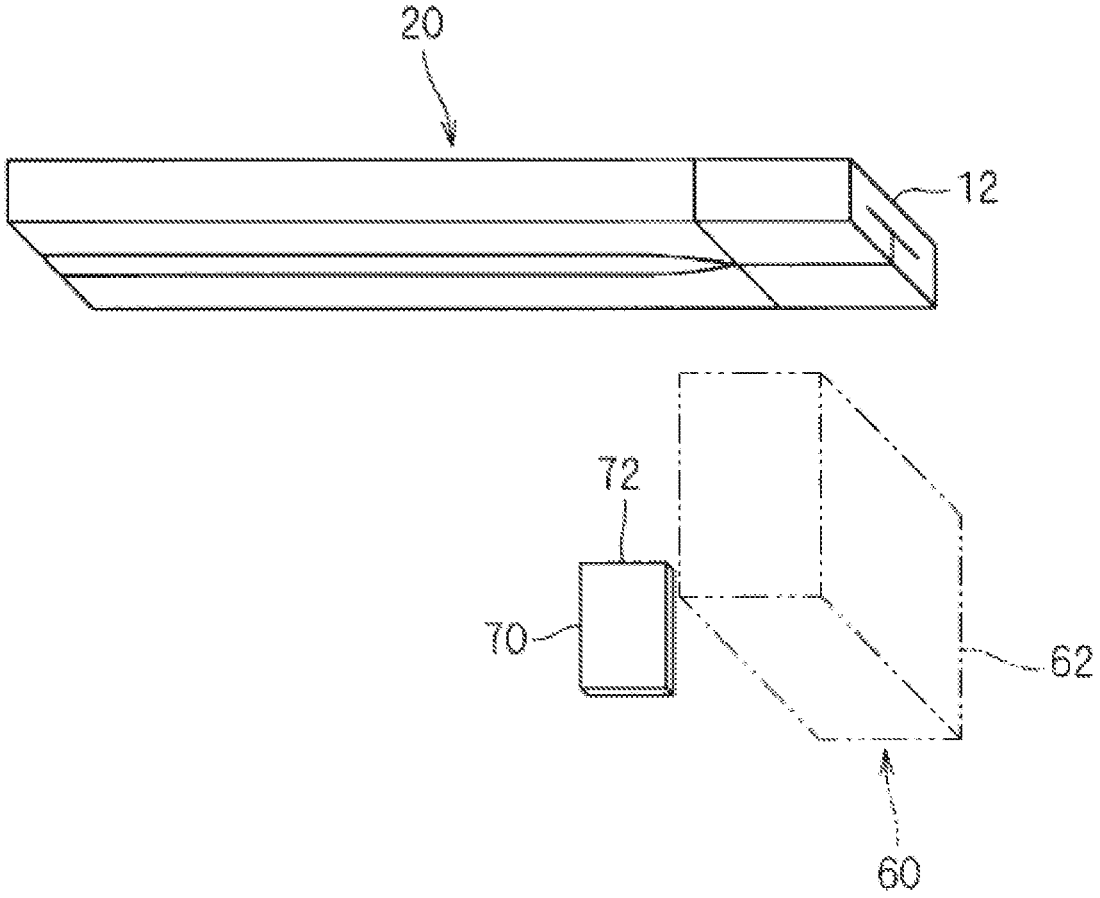
FIG. 15 is an explanatory diagram illustrating the step of crimping the terminal to the bonded portion.
Figure 16:
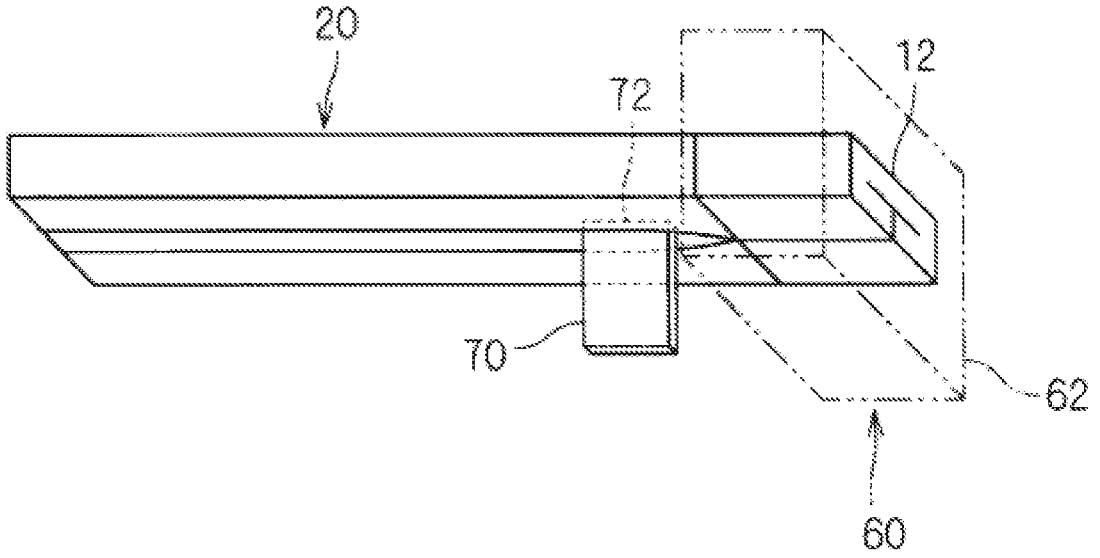
FIG. 16 is an explanatory diagram illustrating the step of crimping the terminal to the bonded portion.

After the band-shaped metal wire member 20 that includes the bonded portion 12 is produced as described above, the terminal 16 is crimped to the bonded portion 12 (step (B)). As illustrated in FIGS. 14 to 16, in this step, terminal crimping can be performed in a state where a positioning member 70 is inserted into a gap between the two side edge portions of the band-shaped metal wire member 20, at a location on the band-shaped metal wire member 20 adjacent to the bonded portion 12.

Specifically, a terminal crimping device 60 includes a bottom terminal die 62 and a top terminal die 64. A bottom die surface 63 is formed in the bottom terminal die 62, the bottom die surface 63 having a recessed shape in which the crimping portion 17 of the terminal 16 can be placed as on a stage. In addition, a top die surface 65 is formed in the top terminal die 64, the top die surface 65 capable of being inserted to the bottom die surface 63 and causing the pair of crimping tabs 17*b* of the crimping portion 17 placed on the bottom die surface 63 to deform inward.

Then, in a state where the crimping portion 17 of the terminal 16 is placed on the bottom die surface 63 and the bonded portion 12 of the band-shaped metal wire member 20 is arranged within the crimping portion 17, the top terminal die 64 is pressed toward the bottom terminal die 62 by an air cylinder, hydraulic cylinder, or other actuator, thereby deforming the pair of crimping tabs 17*b* inward and crimping the crimping portion 17 to the bonded portion 12.

When the band-shaped metal wire member 20 is arranged within the crimping portion 17, and after so arranging the band-shaped metal wire member 20, the bonded portion 12 is preferably placed in the crimping portion 17 in a fixed orientation and posture, and that state is preferably maintained.

Given this, the positioning member 70 is provided to a portion adjacent to the bottom terminal die 62 and below a portion of the band-shaped metal wire member 20 that is adjacent to the bonded portion 12.

The positioning member 70 includes a plate-shaped portion 72. The plate-shaped portion 72 stands upright in a posture that follows the extension direction of the band-shaped metal wire member 20, extending from the bonded portion 12 which is placed in the crimping portion 17.

Then, when the bonded portion 12 is accommodated within the crimping portion 17 that is placed in the bottom terminal die 62, the gap between the two side edge portions of the band-shaped metal wire member 20 is arranged facing the plate-shaped portion 72 of the positioning member 70. Accordingly, the foremost end of the plate-shaped portion 72 is inserted into the gap between the two side edge portions of the band-shaped metal wire member 20 (see FIG. 16), and the band-shaped metal wire member 20 can maintain a fixed position and a fixed posture.

In this state, the crimping portion 17 of the terminal 16 is crimped to the bonded portion 12 between the bottom terminal die 62 and the top terminal die 64, producing the terminal-equipped band-shaped metal wire member 10.

According to the present embodiment as noted above, the inner surface of the depression 53 of the bottom die 52 includes the central die surface 53*a* and the pair of curved guide die surfaces 53*b*. Also, the bonding process portion of the band-shaped metal wire member 20B is arranged within the depression 53 such that the two side edge portions of the bonding process portion are oriented toward the interior of the depression 53, and the projection 57 is inserted into the depression 53 in this state, pressing the bonding process portion within the depression 53. The two side edge portions of the bonding process portion are then guided to the width-direction center of the base of the depression 53 by the pair of curved guide die surfaces 53*b*, and when the two side edge portions reach the central die surface 53*a*, which curves gently or is a flat surface, the two side edge portions remain in a stable state. Therefore, the band-shaped metal wire member 20B can be stably accommodated within the die. In addition, in this state, the metal wires 15 in the bonding process portion are bonded together between the projection 57 and the depression 53, and this enables formation of a bonded portion 12 having a stable shape.

In particular, when the width dimension L of the central die surface 53*a* is set to a width dimension no more than two times the thickness dimension D of the band-shaped metal wire member 20B, a state can be achieved where the two side edge portions of the bonding process portion are more reliably positioned at the width-direction center of the depression 53, and a bonded portion 12 having a more stabilized shape can be formed.

In addition, when the central die surface 53*a* is a flat surface, the two side edge portions of the bonding process portion can more stably remain in a state where the two side edge portions reach the central die surface 53*a*, and a bonded portion 12 having a more stabilized shape can be formed.

In addition, with the bonded portion 12 formed as described above, the gap in the two side edge portions of the band-shaped metal wire member 20 is stably formed at the width-direction center position of the band-shaped metal wire member 20. Given this, the terminal 16 is crimped to the bonded portion 12 in a state where the positioning member 70 is inserted into the gap in the two side edge portions of the band-shaped metal wire member 20 at the bonded portion 12, and this enables the format of crimping the bonded portion 12 and the terminal 16 together to be stabilized.

Modifications

In the embodiment described above, an example was given of forming the bonded portion 12 on an end portion of the band-shaped metal wire member 20. However, a bonded portion may also be formed at a portion of an extension-direction central portion of a band-shaped metal wire member, or along the entire extension direction of the band-shaped metal wire member.

The configurations described in the above embodiment and modifications can be combined as appropriate so long as they do not contradict each other.

In the above, the present invention is described in detail. However, the above description is, in all aspects, for exemplary purposes and the present invention is not limited by the description. Numerous modifications not given as examples are understood to be conceivable without departing from the scope of the present invention.

DESCRIPTION OF REFERENCE NUMERALS

10 Terminal-equipped band-shaped metal wire member
12 Bonded portion
12*a* Central surface
12*b* Curved surface
15 Metal wire
16 Terminal
17 Crimping portion
20 Band-shaped metal wire member
20B Band-shaped metal wire member
50 Die
52 Bottom die
53 Depression
53*a* Central die surface
53*b* Curved guide die surface
56 Top die
57 Projection
60 Terminal crimping device
62 Bottom terminal die
64 Top terminal die
70 Positioning member
72 Plate-shaped portion

The invention claimed is:

1. A method of manufacturing a band-shaped metal wire member that includes a bonded portion, the method comprising:

(a) preparing a die that includes a first die provided with a depression and a second die provided with a projection that can be arranged within the depression so as to close off a space above the depression, an inner surface of the depression including a central die surface formed at a width-direction center of a base of the depression and a pair of curved guide die surfaces provided continuous with two sides of the central die surface and curved so as to project outward, the central die surface being formed as a flat surface or as a surface with a radius of curvature that is larger than that of the pair of curved guide die surfaces;

(b) folding in two a bonding process portion that is on at least a portion of an extension direction of the band-shaped metal wire member;

(c) arranging the bonding process portion of the band-shaped metal wire member within the depression such that two side edge portions of the bonding process portion are oriented toward the interior of the depression;

(d) inserting the projection into the depression and pressing the bonding process portion within the depression; and (e) bonding metal wires in the bonding process portion together between the projection and the depression.

2. The method of manufacturing the band-shaped metal wire member that includes the bonded portion according to claim 1, wherein the central die surface is set to a width dimension no more than two times a thickness dimension of the band-shaped metal wire member.

3. The method of manufacturing the band-shaped metal wire member that includes the bonded portion according to claim 1, wherein the central die surface is a flat surface.

4. A method of manufacturing a terminal-equipped band-shaped metal wire member comprising:

(A) manufacturing a band-shaped metal wire member that includes a bonded portion with the method of manufacturing a band-shaped metal wire member that includes a bonded portion according to claim 1; and (B) crimping a terminal to the bonded portion in a condition in which a positioning member is inserted into a gap between two side portions of the band-shaped metal wire member, at a location on the band-shaped metal wire member adjacent to the bonded portion.

5. A die that bonds a plurality of metal wires together in at least a portion of an extension direction of a band-shaped metal wire member, the die comprising:

a first die provided with a depression; and a second die provided with a projection that can be arranged within the depression so as to close off a space above the depression, the projection including an inner side that includes a pair of curved surfaces at opposing ends of the inner side and that includes a straight surface connecting the pair of curved surfaces, wherein an inner surface of the depression includes a central die surface formed at a width-direction center of a base of the depression and a pair of curved guide die surfaces provided continuous with two sides of the central die surface and curved so as to project outward, and the central die surface is formed as a flat surface or as a surface with a radius of curvature that is larger than that of the pair of curved guide die surfaces.

6. A band-shaped metal wire member comprising:

a bonded portion, wherein the bonded portion is formed by bonding a plurality of metal wires together in at least a portion of an extension direction of the band-shaped metal wire member, the band-shaped metal wire member being assembled such that the plurality of metal wires form an elongated band shape, the bonded portion is formed by bonding the plurality of metal wires together in a condition in which two side portions of the band-shaped metal wire member are deformed such that two side edge portions of the band-shaped metal wire member face each other and the two side portions meet on one principal surface side at a width-direction center portion of the band-shaped metal wire member, and an outer circumferential surface of the bonded portion includes a central surface formed at the portion where the two side edge portions of the band-shaped metal wire member face each other, and a pair of curved surfaces that are provided continuous with two sides of the central surface and are curved so as to project outward, the central surface being formed as a flat surface or as a surface with a radius of curvature that is larger than that of the pair of curved surfaces.

* * * * *